US009288579B2

(12) United States Patent
Choi et al.

(10) Patent No.: US 9,288,579 B2
(45) Date of Patent: Mar. 15, 2016

(54) METHOD FOR DYNAMICALLY ADJUSTING GAIN OF PARAMETRIC EQUALIZER ACCORDING TO INPUT SIGNAL, DYNAMIC PARAMETRIC EQUALIZER AND DYNAMIC PARAMETRIC EQUALIZER SYSTEM EMPLOYING THE SAME

(71) Applicant: NEOFIDELITY, INC., Seoul (KR)

(72) Inventors: Yeongha Choi, Seoul (KR); Duckhwan Kim, Seoul (KR)

(73) Assignee: NEOFIDELITY, Inc., Seoul (KR)

( * ) Notice: Subject to any disclaimer, the term of this patent is extended or adjusted under 35 U.S.C. 154(b) by 225 days.

(21) Appl. No.: 14/165,975

(22) Filed: Jan. 28, 2014

(65) Prior Publication Data

US 2014/0211968 A1 Jul. 31, 2014

(30) Foreign Application Priority Data

Jan. 28, 2013 (KR) ..... 10-2013-0009176
Jan. 28, 2013 (KR) ..... 10-2013-0009177

(51) Int. Cl.
*H04R 3/04* (2006.01)

(52) U.S. Cl.
CPC ..... *H04R 3/04* (2013.01); *H04R 2499/15* (2013.01)

(58) Field of Classification Search
CPC ..... H04R 3/00; H04R 3/04; H04R 3/06; H04R 3/08; H04R 2430/00; H04R 2430/01; H04S 7/301; H03G 5/00; H03G 5/005; H03G 5/16; H03G 5/165; H03G 3/00; H03G 3/20; H03G 3/3094
USPC ..... 381/87, 103, 94.1–94.3, 98, 104, 107
See application file for complete search history.

(56) References Cited

U.S. PATENT DOCUMENTS 8,160,274 B2 * 4/2012 Bongiovi ..... H04R 1/005 381/100
8,229,136 B2 * 7/2012 Bongiovi ..... H03G 9/005 381/100
8,284,955 B2 * 10/2012 Bonglovi ..... H04S 7/307 381/100
2010/0284528 A1 * 11/2010 Bongiovi ..... H04L 25/03012 379/207.16
2013/0101129 A1 * 4/2013 Christoph ..... G10K 11/178 381/71.1

* cited by examiner

*Primary Examiner* — Paul S Kim
*Assistant Examiner* — Sabrina Diaz
(74) *Attorney, Agent, or Firm* — Stein IP, LLC

(57) ABSTRACT

The present invention relates to a method for dynamically adjusting a gain of parametric equalizer according to an input signal, a dynamic parametric equalizer employing the same and a dynamic parametric equalizer system employing the same wherein a gain of parametric equalizer is dynamically adjusted according to a level of an input digital audio signal to prevent distortion of output signal.

18 Claims, 10 Drawing Sheets

Prior Art

Prior Art

METHOD FOR DYNAMICALLY ADJUSTING GAIN OF PARAMETRIC EQUALIZER ACCORDING TO INPUT SIGNAL, DYNAMIC PARAMETRIC EQUALIZER AND DYNAMIC PARAMETRIC EQUALIZER SYSTEM EMPLOYING THE SAME

CROSS-REFERENCE TO RELATED PATENT APPLICATION

This U.S. non-provisional patent application claims priority under 35 U.S.C. §119 of Korean Patent Applications No. 10-2013-0009176 and No. 10-2013-0009177 both filed on Jan. 28, 2013 in the Korean Intellectual Property Office, the entire contents of which are hereby incorporated by reference.

BACKGROUND OF THE INVENTION

1. Field of the Invention

The present invention relates to a method for dynamically adjusting a gain of parametric equalizer according to an input signal, a dynamic parametric equalizer employing the same and a dynamic parametric equalizer system employing the same, and more particularly to a method, a dynamic parametric equalizer and a dynamic parametric equalizer system wherein a gain of parametric equalizer is dynamically adjusted according to a level of an input digital audio signal.

2. Description of the Related Art

Parametric equalizer is an equalizer capable of configuring parameters such as a band and a gain according to user's preference. The parametric equalizer constitutes an audio tuning circuit included in a digital audio playback device in order to match a digital audio signal to a playback capability of a speaker. For instance, the parametric equalizer is used to tune a characteristic of a digital audio signal in order to match a characteristic of a speaker built into a digital television. When a bass playback capability of the speaker built into the digital television is poor, bass playback may be appropriately carried out without any distortion when the characteristic of the digital audio signal is properly tuned using the parametric equalizer. That is, the parametric equalizer is used to generate a signal suitable for the playback capability of the speaker. The parametric equalizer comprises digital filters which are designed considering the playback capability of the speaker at the time of designing the digital audio playback device.

FIG. 1A is a graph exemplifying a transfer function of a conventional parametric equalizer. As shown in FIG. 1A, the conventional parametric equalizer amplifies a signal within a bandwidth Q about a center frequency $f_{center}$ according to a preset gain G.

FIG. 1B is a graph exemplifying a transfer function of another conventional parametric equalizer. As shown in FIG. 1B, the conventional parametric equalizer amplifies a signal with a frequency lower than a cut-off frequency $f_c$ according to a preset gain G.

FIG. 1C is a graph exemplifying a transfer function of yet another conventional parametric equalizer. As shown in FIG. 1C, the conventional parametric equalizer amplifies a signal with a frequency higher than a cut-off frequency $f_c$ according to a preset gain G.

As shown in FIGS. 1A through 1C, the conventional parametric equalizer amplifies a signal of a predetermined band according to preset parameters. When a level of the signal inputted to the parametric equalizer is relatively small, the amplification can be performed without any distortion. However, when the level of the signal inputted to the parametric equalizer is relatively large, the amplification may result in a clipping of the signal.

In order to prevent the clipping, the gain of the parametric equalizer should be adjusted in real time according to the level of the input signal. That is, when the level of the input signal is low such that the clipping should not occur, the input signal should be amplified by the preset gain G. When the level of the input signal is high such that the clipping should occur, the input signal should be amplified by a gain lower than the preset gain G to prevent the clipping.

As shown in FIGS. 1A through 1C, the parametric equalizer is embodied by a filter. For instance, when the parametric equalizer is embodied by a second order IIR (Infinite Impulse Response) filter, the transfer function of the parametric equalizer is represented by equation 1 below.

$$H(z) = \frac{b_0 + b_1 z^{-1} + b_2 z^{-2}}{1 + a_1 z^{-1} + a_2 z^{-2}} \quad \text{[Equation 1]}$$

In order to prevent the clipping, the gain of the parametric equalizer should be dynamically varied according to the level of the input signal. That is, the parameters of the filter constituting the parametric equalizer should be changed in real time. Since the parameters of the filter are defined by coefficients of Equation 1, coefficients $a_1$, $a_2$, $b_0$, $b_1$ and $b_2$ should be calculated every time the gain is changed.

Since the calculation of the coefficients of the IIR filter in real time is very complex and requires high performance arithmetic hardware, the constitution of the hardware becomes more complex and the manufacturing cost thereof rises.

SUMMARY OF THE INVENTION

It is an object of the present invention to provide a method for dynamically adjusting a gain of parametric equalizer according to an input signal, a dynamic parametric equalizer employing the same and a dynamic parametric equalizer system employing the same without real time calculation of coefficients of a filter used in the dynamic parametric equalizer and the dynamic parametric equalizer system.

In order to achieve the object of the present invention, there is provided a parametric equalizer having a transfer function H(z) with a preset gain G as a parameter, the parametric equalizer dynamically adjusting the preset gain G, the parametric equalizer comprising: a first signal processing unit having a transfer function $H_1$, the first signal processing unit being configured to process an input digital audio signal X according to the transfer function $H_1$ and output a first output signal obtained by processing the input digital audio signal X; a second signal processing unit having a transfer function $H_2$ of a level Gin of the first output signal, the second signal processing unit being configured to process the first output signal according to the transfer function $H_2$ and output a second output signal obtained by processing the first output signal; and an adder configured to add the second output signal to the input digital audio signal X to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

There is also provided a method of dynamically adjusting a preset gain G of a parametric equalizer having a transfer function H(z) with the preset gain G as a parameter, the method comprising: (a) inputting an input digital audio signal X to a first signal processing unit having a transfer function $H_1$ and processing the input digital audio signal X according to the transfer function $H_1$ to generate an output signal $Y_1$; (b) inputting the output signal $Y_1$ to a second signal processing unit having a transfer function $H_2$ of a level Gin of the output signal $Y_1$ and processing the output signal $Y_1$ according to the transfer function $H_2$ to generate an output signal $Y_2$; and (c) adding the output signal $Y_2$ to the input digital audio signal X to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

Preferably, $Y=H(z)X$ when $0<Gin<1/G$, a level of the output digital audio signal Y is maintained by monotonically decreasing the preset gain G when $1/G\leq Gin\leq 1$, and the output digital audio signal Y is equal to the input digital audio signal X when $1<Gin$.

There is also provided a parametric equalizer system having a transfer function H(z) with a preset gain G as a parameter, the parametric equalizer dynamically adjusting the preset gain G, the parametric equalizer comprising: a first signal processing unit configured to process an signal $X_1$ according to the transfer function $H_1$ to generate an output signal $Y_1$; a level detector configured to detect a level Gin of the output signal $Y_1$; a second signal processing unit configured to process the output signal $Y_1$ according to the transfer function $H_2$ of the level Gin detected by the level detector to generate an output signal $Y_2$; and an adder configured to add the an output signal $Y_2$ to the signal $X_1$ to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

There is also provided a method of dynamically adjusting a preset gain G of a parametric equalizer having a transfer function H(z) with a preset gain G as a parameter, the method comprising: (a) inputting a signal $X_1$ to a first signal processing unit having a transfer function $H_1$ and processing the signal $X_1$ according to the transfer function $H_1$ to generate an output signal $Y_1$; (b) detecting a level Gin of the output signal $Y_1$; (c) inputting the output signal $Y_1$ to a second signal processing unit having a transfer function $H_2$ of the level Gin detected in the step (b) and processing the output signal $Y_1$ according to the transfer function $H_2$ to generate an output signal $Y_2$; and (d) adding the output signal $Y_2$ to the signal $X_1$ to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

Preferably, $Y=H(z)X$ when $0<Gin<1/G$, a level of the output digital audio signal Y is maintained by monotonically decreasing the preset gain G when $1/G\leq Gin\leq 1$, and the output digital audio signal Y is equal to the input digital audio signal $X_1$ when $1<Gin$.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

The present invention will now be described in detail with reference to the accompanied drawings.

Figure 2:
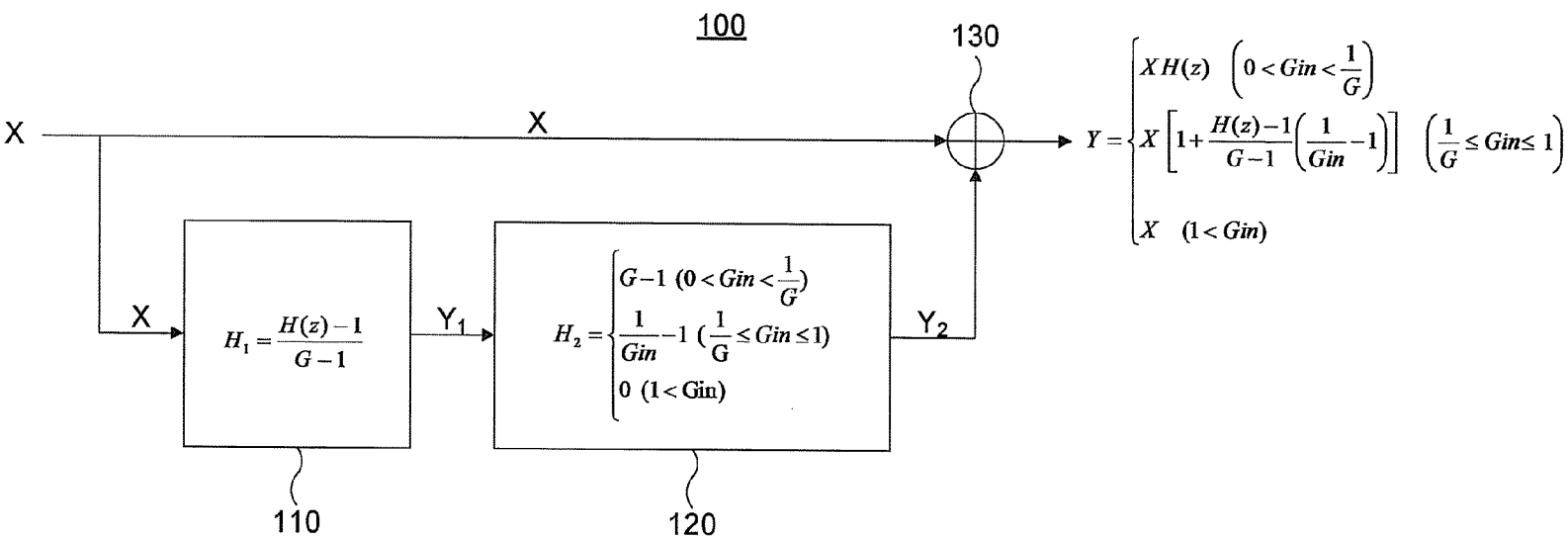
FIG. 2 is a block diagram illustrating a parametric equalizer in accordance with the present invention.

FIG. 2 is a block diagram illustrating a parametric equalizer in accordance with the present invention.

Referring to FIG. 2, a parametric equalizer 100 comprises a first signal processing unit 110, a second signal processing unit 120 and an adder 130.

The first signal processing unit 110 processes an input digital audio signal X (PCM signal, for example) according to its transfer function $H_1$ and outputs an output signal $Y_1$ ($=XH_1$).

The transfer function $H_1$ is defined in Equation 2 below.

$$H_1 = \frac{H(z)-1}{G-1}, \qquad \text{[Equation 2]}$$

where H(z) is the transfer function of the parametric equalizer 100, and G is a preset gain of the parametric equalizer.

Figure 1A:
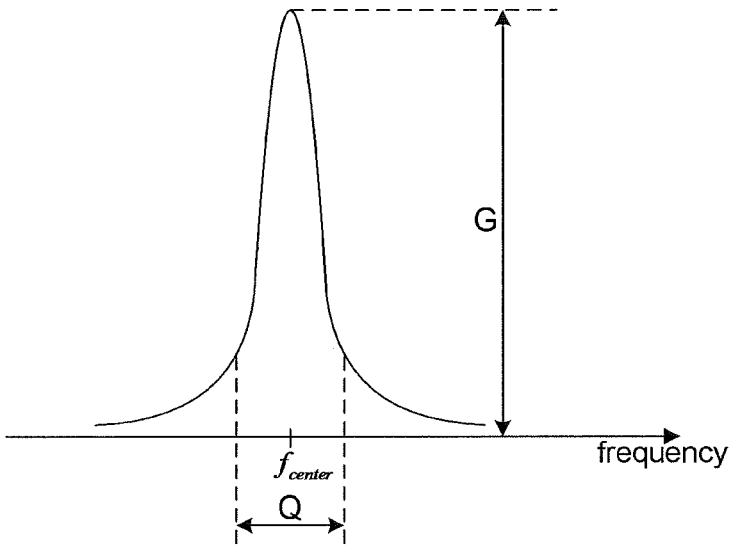
FIG. 1A through FIG. 1C are graphs exemplifying transfer functions of conventional parametric equalizers.
Figure 1B:
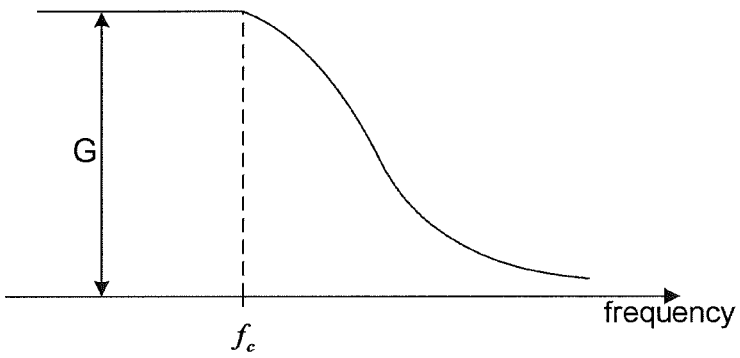
Prior Art FIG. 1B
Figure 1C:
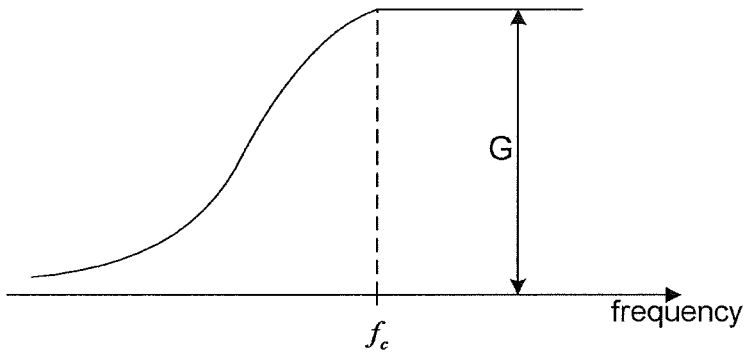
Figure 3A:
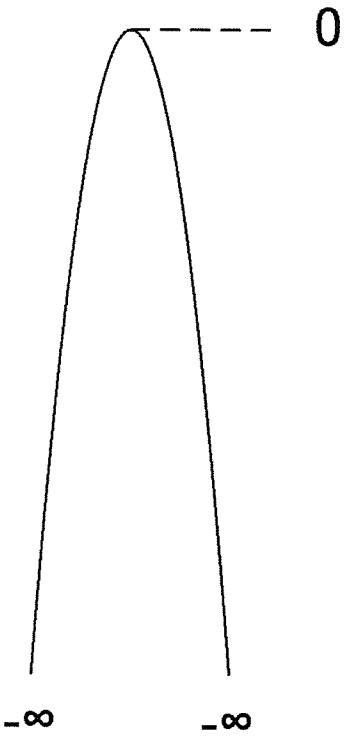
FIG. 3A through FIG. 3C are graphs depicting transfer function $H_1$.
Figure 3B:
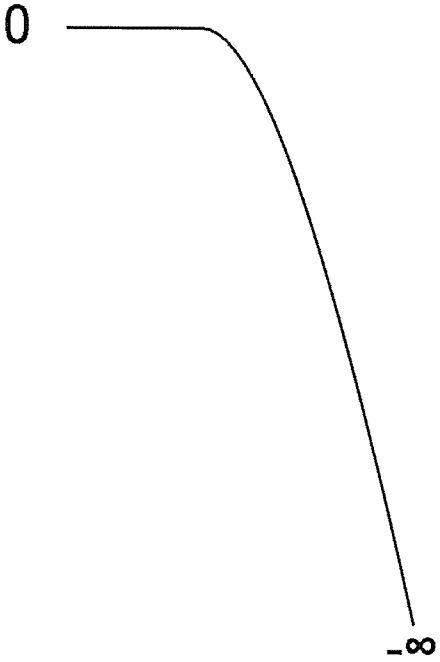
Figure 3C:
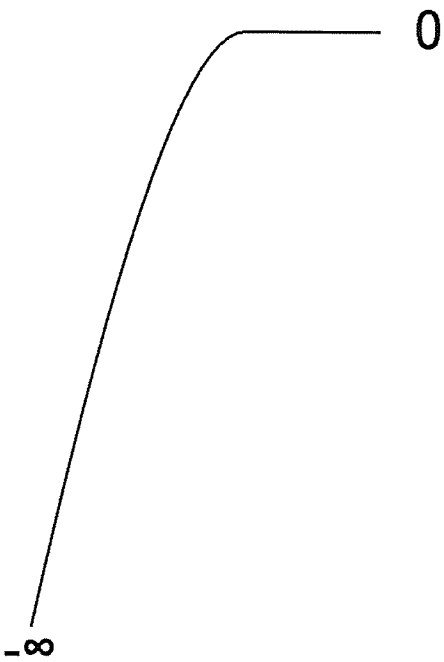

FIGS. 3A through 3C exemplify the transfer function $H_1$. As shown in FIGS. 3A through 3C, $H_1$ is obtained by shifting H(z) by −1 along y axis. Specifically, in case of H(z) shown in FIG. 1A, $H_1$ extends from −∞ to 0, and then from 0 to −∞ (−∞→0→−∞) in dB (decibel) scale as shown in FIG. 3A. In case of H(z) shown in FIG. 1B, $H_1$ extends from 0 to −∞ (0→−∞) in dB scale as shown in FIG. 3B. In case of H(z) shown in FIG. 1C, $H_1$ extends from −∞ to 0 (−∞→0) in dB scale as shown in FIG. 3C. However, $H_1$ is not limited to functions shown in FIGS. 3A through 3C and may have various forms.

Since the transfer function $H_1$ of the first signal processing unit 110 is obtained by shifting H(z), the coefficients of the transfer function $H_1$ can be pre-calculated from Equation 2 and are not required to be calculated in real time.

Still referring to FIG. 2, the second signal processing unit 120 processes the output signal $Y_1$ of the first signal processing unit 110 by its transfer function $H_2$ according to a level Gin of the output signal $Y_1$ and outputs an output signal $Y_2$ ($=XH_1H_2$).

The transfer function $H_2$ is defined in Equation 3 below.

$$H_2 = \begin{cases} G-1 & \left(0 < Gin < \frac{1}{G}\right) \\ \frac{1}{Gin} - 1 & \left(\frac{1}{G} \leq Gin \leq 1\right) \\ 0 & (1 < Gin) \end{cases} \qquad \text{[Equation 3]}$$

The adder 130 adds the output signal $Y_2$ of the second signal processing unit 120 to the input digital audio signal X to generate an output digital audio signal Y.

The output digital audio signal Y according to the range of Gin may be calculated as below.

$$0 < Gin < \frac{1}{G} \quad \text{(i)}$$

Since $H_2$=G−1 from Equation 3, the output digital audio signal Y is expressed as Equation 4.

$$\begin{aligned} Y &= X + H_1 H_2 X \\ &= X[1 + H_1 H_2] \\ &= X\left[1 + \frac{H(z)-1}{G-1}(G-1)\right] \\ &= XH(z) \end{aligned} \quad \text{[Equation 4]}$$

Y/X obtained from Equation 4 can be expressed as Equation 5.

$$\frac{Y}{X} = H(z) \quad \text{[Equation 4]}$$

Equation 5 means that the preset gain G of the parametric equalizer 100 in accordance with the present invention does not change. That is, when the level Gin of the output signal $Y_1$ of the first signal processing unit 110 is smaller than 1/G, the parametric equalizer 100 in accordance with the present invention processes the input digital audio signal X according to the preset gain G without dynamically changing the preset gain G.

$$\frac{1}{G} \le Gin \le 1 \quad \text{(ii)}$$

Since $$H_2 = \frac{1}{Gin} - 1$$

from Equation 3, the output digital audio signal Y is expressed as Equation 6 below.

$$\begin{aligned} Y &= X + H_1 H_2 X \\ &= X[1 + H_1 H_2] \\ &= X\left[1 + \frac{H(z)-1}{G-1}\left(\frac{1}{Gin} - 1\right)\right] \end{aligned} \quad \text{[Equation 6]}$$

Y/X obtained from Equation 6 can be expressed as Equation 7 below.

$$\frac{Y}{X} = 1 + \frac{H(z)-1}{G-1}\left(\frac{1}{Gin} - 1\right) \quad \text{[Equation 7]}$$

When $$\left(\frac{1}{Gin} - 1\right) \Big/ (G-1)$$

is set as G', Y/X can be expressed as Equation 8 below.

$$\begin{aligned} \frac{Y}{X} &= 1 + [H(z) - 1]G' \\ &= G'H(z) + 1 - G' \end{aligned} \quad \text{[Equation 8]}$$

Figure 4:
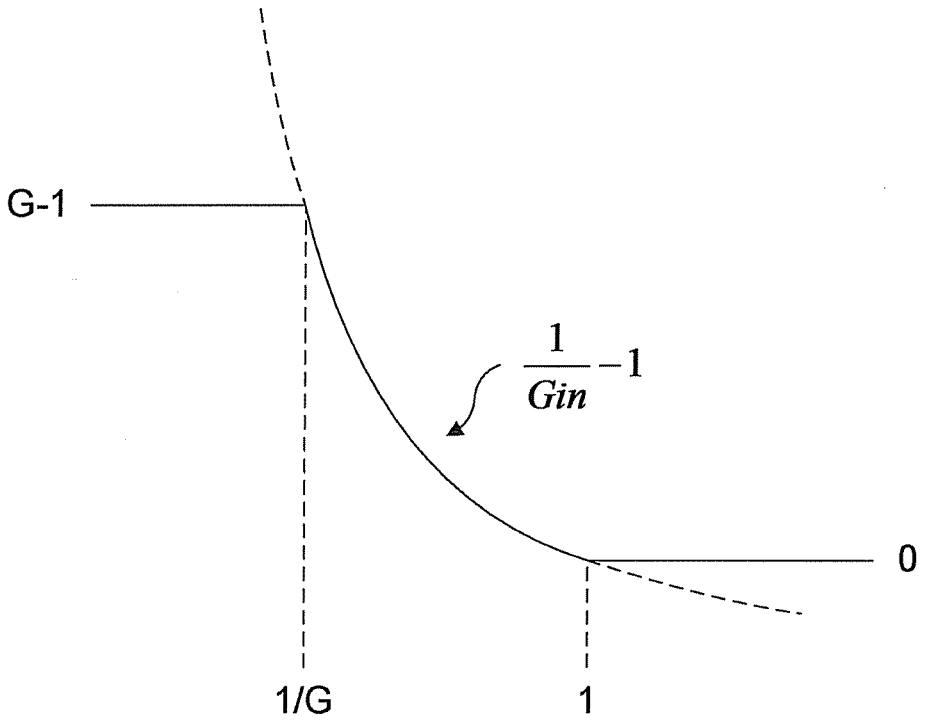
FIG. 4 is a graph depicting transfer function $H_2$.

As shown in FIG. 4, G' monotonically decreases when $$\frac{1}{G} \le Gin \le 1$$

because $$\left(\frac{1}{Gin} - 1\right)$$

monotonically decreases in the range $$\frac{1}{G} \le Gin \le 1.$$

G' has a maximum value of 1 when $$Gin = \frac{1}{G},$$

and a minimum value of 0 when Gin=1. Accordingly, $$\frac{Y}{X} = H(z)$$

when G'=1, and $$\frac{Y}{X} = 1$$

when G'=0. As a result, the gain of the parametric equalizer 100 in accordance with the present invention monotonically decreases when $$\frac{1}{G} \le Gin \le 1.$$

That is, the gain of the parametric equalizer 100 dynamically varies in response to the level Gin even when the coefficients are not calculated in real time according to the level Gin.

In Equation 7, since the gain of H(z) is G, the gain of $$\frac{H(z)-1}{G-1} \text{ is } 1.$$

Thus, the level of the input digital audio signal X is equal to that of the output signal $Y_1$ (=Gin). Further, in Equation 7, since the gain of Y/X is Gin and the level of the input digital audio signal X is Gin, the level of the output digital audio signal Y is 1 regardless of the level of the input digital audio signal X when $$\frac{1}{G} \le Gin \le 1.$$

$$1 < Gin \quad \text{(iii)}$$

Since $H_2=0$ from Equation 3, the output digital audio signal Y is expressed as Equation 9 below.

$$Y=X \quad \text{[Equation 9]}$$

Equation 9 means that the parametric equalizer in accordance with the present invention outputs the input digital audio signal X as the output digital audio signal Y when 1<Gin. That is, when the level Gin of the output signal $Y_1$ of the first signal processing unit 110 is greater than 1, the parametric equalizer in accordance with the present invention outputs the input digital audio signal X as the output digital audio signal Y without amplifying the input digital audio signal X.

Figure 5:
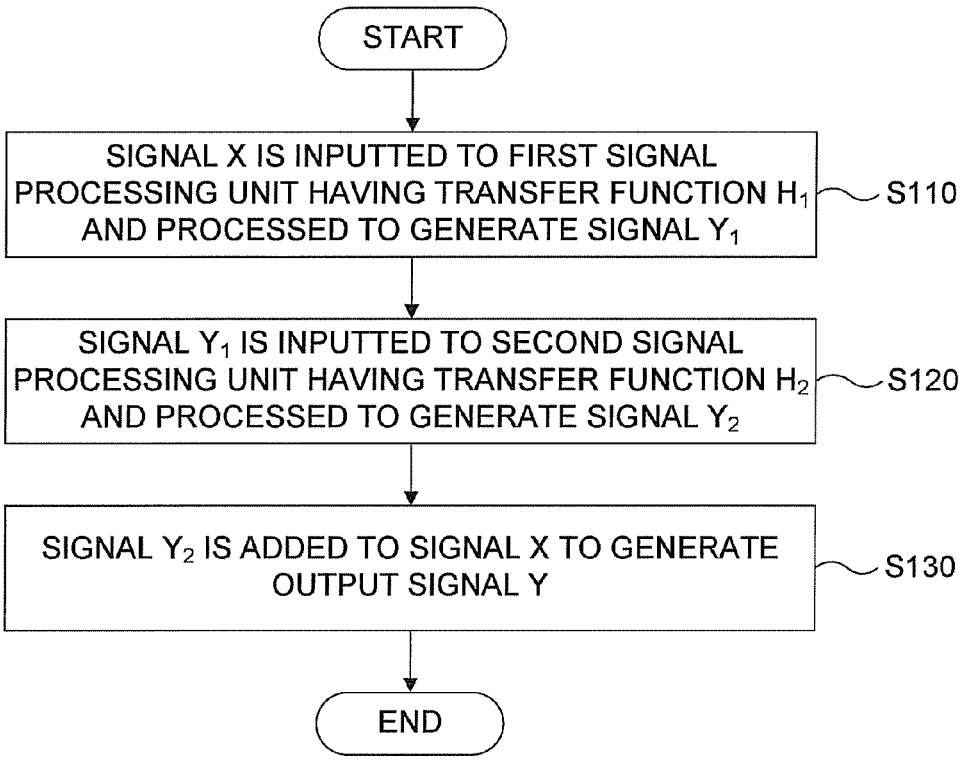
FIG. 5 is a flow diagram illustrating a method for adjusting a gain of a parametric equalizer in accordance with the present invention.

FIG. 5 is a flow diagram illustrating a method for adjusting a gain of a parametric equalizer in accordance with the present invention.

Referring to FIG. 5, an input digital audio signal X is inputted to a first signal processing unit having a transfer function $H_1$ and processed by the transfer function $H_1$ (S110). The transfer function $H_1$ is defined in Equation 2 above.

That is, the input digital audio signal X is inputted to the first signal processing unit having the transfer function $H_1$, and the input digital audio signal X is processed by the first signal processing unit to generate an output signal $Y_1$ ($=XH_1$).

Thereafter, the output signal $Y_1$ of the first signal processing unit is inputted to a second signal processing unit having a transfer function $H_2$ and processed (S120). The transfer function $H_2$ is defined in Equation 3 above.

That is, the output signal $Y_1$ of the first signal processing unit is inputted to the second signal processing unit having the transfer function $H_2$ and the second signal processing unit processes the output signal $Y_1$ of the first signal processing unit according to the transfer function $H_2$ to generate an output signal $Y_2$ ($=XH_1H_2$).

Figure 6:
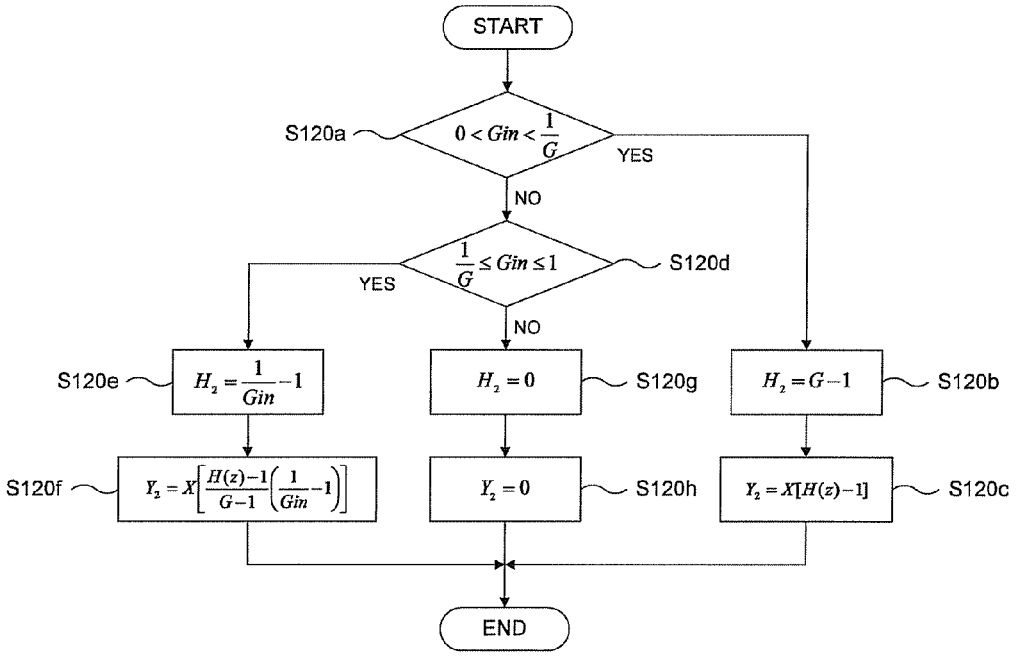
FIG. 6 is a flow diagram illustrating step S120 of FIG. 5.

The step S120 will be described in more detail below with reference to FIG. 6.

When $$0 < Gin < \frac{1}{G} (S120a),$$

the transfer function $H_2$ is expressed as $H_2=G-1$ as in Equation 3 (S120*b*), and the second signal processing unit generates the output signal $Y_2$ ($=X[H(z)-1]$) (S120*c*).

When $$\frac{1}{G} \le Gin \le 1 (S120d),$$

the transfer function $H_2$ is expressed as $$H_2 = \frac{1}{Gin} - 1$$

as in Equation 3 (S120*e*), and the second signal processing unit generates the output signal $$Y_2\left( = X\left[\frac{H(z)-1}{G-1}\left(\frac{1}{Gin} - 1\right)\right]\right) (S120f).$$

When 1<Gin, the transfer function $H_2$ is expressed as $H_2=0$ as in Equation 3 (S120*g*), and the second signal processing unit generates the output signal $Y_2$ (=0) (S120*h*).

Referring back to FIG. 5, the output signal $Y_2$ is then added to the input digital audio signal X to generate an output digital audio signal Y (S130).

The output digital audio signal Y for $$0 < Gin < \frac{1}{G}$$

is expressed as Equation 4 above. The gain G of the parametric equalizer is not varied when $$0 < Gin < \frac{1}{G}$$

and the input digital audio signal is processed according to the preset gain G.

The output digital audio signal Y for $$\frac{1}{G} \le Gin \le 1$$

is expressed as Equation 6 above. When the level Gin is equal to or greater than 1/G and equal to or less than 1, the gain of the parametric equalizer monotonically decreases. That is, the gain of the parametric equalizer may be dynamically adjusted according to the level Gin without calculating the coefficients of H(z) in real time.

The output digital audio signal Y for 1<Gin is expressed as Equation 9 above. When 1<Gin, the input digital audio signal X is equal to the output digital audio signal Y. That is, when the level Gin of the output signal $Y_1$ is greater than 1, the input digital audio signal X is outputted as the output digital audio signal Y without amplification.

Figure 7:
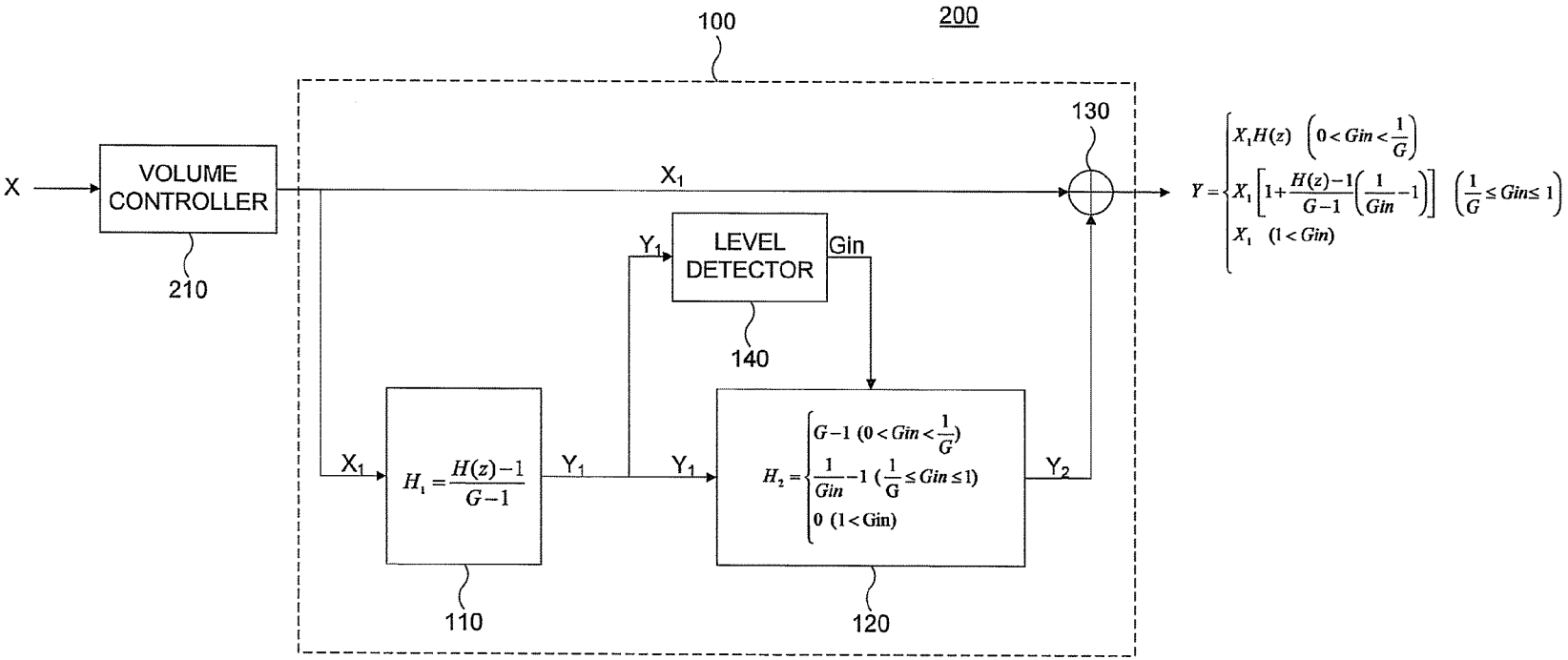
FIG. 7 is a block diagram illustrating a parametric equalizer system in accordance with the present invention.

FIG. 7 is a block diagram illustrating a parametric equalizer system in accordance with the present invention.

Referring to FIG. 7, the parametric equalizer system 200 comprises a volume controller 210 and a parametric equalizer 100 including a first signal processing unit 110, a second signal processing unit 120, an adder 130 and a level detector 140.

The volume controller 210 adjusts a level of an input digital audio signal X and outputs the adjusted input digital audio signal X as an output signal $X_1$. The volume controller 210 increases or decreases the level of the input digital audio signal X according to a selection of a user. The input digital audio signal X may include a PCM audio signal.

The first signal processing unit 110 processes the output signal $X_1$ according to its transfer function $H_1$ and outputs an output signal $Y_1$ ($=X_1H_1$).

The transfer function is defined in Equation 2 above.

The level detector 140 detects a level Gin of the output signal $Y_1$ of the first signal processing unit 110 and provides the output signal $Y_1$ to the second signal processing unit 120.

The gain G may be dynamically adjusted in real time according to the level Gin of the output signal $Y_1$ of the first signal processing unit 110. That is, the output signal $X_1$ is amplified or bypassed with out any amplification or the gain G is adjusted to be inversely proportional to an amplitude of the level Gin of the output signal $Y_1$ of the first signal processing unit 110.

The second signal processing unit 120 processes the output signal $Y_1$ of the first signal processing unit 110 by its transfer function $H_2$ according to the level Gin of the output signal $Y_1$ and outputs the processed output signal $Y_1$ as an output signal $Y_2$ ($=X_1H_1H_2$).

The transfer function $H_2$ is defined in Equation 3 above and a graph thereof is shown in FIG. 4.

The adder 130 adds the output signal $Y_2$ of the second signal processing unit 120 to the output signal $X_1$ of the volume controller 210 to generate an output digital audio signal Y.

The output digital audio signal Y according to the range of Gin may be calculated as below.

$$0 < Gin < \frac{1}{G} \quad \text{(i)}$$

Since $H_2$=G−1 from Equation 3, the output digital audio signal Y is expressed as Equation 10 below.

$$\begin{aligned} Y &= X_1 + H_1 H_2 X_1 \\ &= X_1[1 + H_1 H_2] \\ &= X_1\left[1 + \frac{H(z)-1}{G-1}(G-1)\right] \\ &= X_1 H(z) \end{aligned} \quad \text{[Equation 10]}$$

$Y/X_1$ obtained from Equation 10 can be expressed as Equation 5 below.

$$\frac{Y}{X_1} = H(z) \quad \text{[Equation 11]}$$

Equation 11 means that the preset gain G of the parametric equalizer 100 in accordance with the present invention does not change. That is, when the level Gin of the output signal $Y_1$ of the first signal processing unit 110 is smaller than 1/G, the parametric equalizer 100 in accordance with the present invention processes the input digital audio signal X according to the preset gain G without dynamically changing the preset gain G.

$$\frac{1}{G} \le Gin \le 1 \quad \text{(ii)}$$

Since $$H_2 = \frac{1}{Gin} - 1$$

from Equation 3, the output digital audio signal Y is expressed as Equation 12 below.

$$\begin{aligned} Y &= X_1 + H_1 H_2 X_1 \\ &= X_1[1 + H_1 H_2] \\ &= X_1\left[1 + \frac{H(z)-1}{G-1}(G-1)\right] \end{aligned} \quad \text{[Equation 12]}$$

$Y/X_1$ obtained from Equation 12 can be expressed as Equation 13 below.

$$\frac{Y}{X_1} = 1 + \frac{H(z)-1}{G-1}\left(\frac{1}{Gin} - 1\right) \quad \text{[Equation 13]}$$

When $$\left(\frac{1}{Gin} - 1\right) \Big/ (G-1)$$

is set as G', $Y/X_1$ can be expressed as Equation 14 below.

$$\begin{aligned} \frac{Y}{X_1} &= 1 + [H(z)-1]G' \\ &= G'H(z) + 1 - G' \end{aligned} \quad \text{[Equation 14]}$$

As shown in FIG. 4, G' monotonically decreases when $$\frac{1}{G} \le Gin \le 1$$

because $$\left(\frac{1}{Gin} - 1\right)$$

monotonically decreases in the range $$\frac{1}{G} \le Gin \le 1.$$

G' has a maximum value of 1 when $$Gin = \frac{1}{G},$$

and a minimum value of 0 when Gin=1. Accordingly, $$\frac{Y}{X_1} = H(z)$$

when G'=1, and $$\frac{Y}{X_1} = 1$$

when G'=0. As a result, the gain of the parametric equalizer 100 in accordance with the present invention monotonically decreases when $$\frac{1}{G} \le Gin \le 1.$$

That is, the gain of the parametric equalizer 100 dynamically varies in response to the level Gin even when the coefficients are not calculated in real time according to the level Gin.

In Equation 13, since the gain of H(z) is G, the gain of $$\frac{H(z)-1}{G-1} \text{ is } 1.$$

Thus, the level of the output signal $X_1$ is equal to that of the output signal $Y_1$ (=Gin). Further, in Equation 13, since the gain of $Y/X_1$ is Gin and the level of the output signal $X_1$ is Gin, the level of the output digital audio signal Y is 1 regardless of the level of the output signal $X_1$ when $$\frac{1}{G} \le Gin \le 1.$$

$$1<Gin \quad \text{(iii)}$$

Since $H_2=0$ from Equation 3, the output digital audio signal Y is expressed as Equation 15 below.

$$Y=X_1 \quad \text{[Equation 15]}$$

Equation 15 means that the parametric equalizer in accordance with the present invention outputs the output signal $X_1$ as the output digital audio signal Y when 1<Gin. That is, when the level Gin of the output signal $Y_1$ of the first signal processing unit 110 is greater than 1, the parametric equalizer in accordance with the present invention outputs the output signal $X_1$ as the output digital audio signal Y without amplifying the output signal $X_1$.

Figure 8:
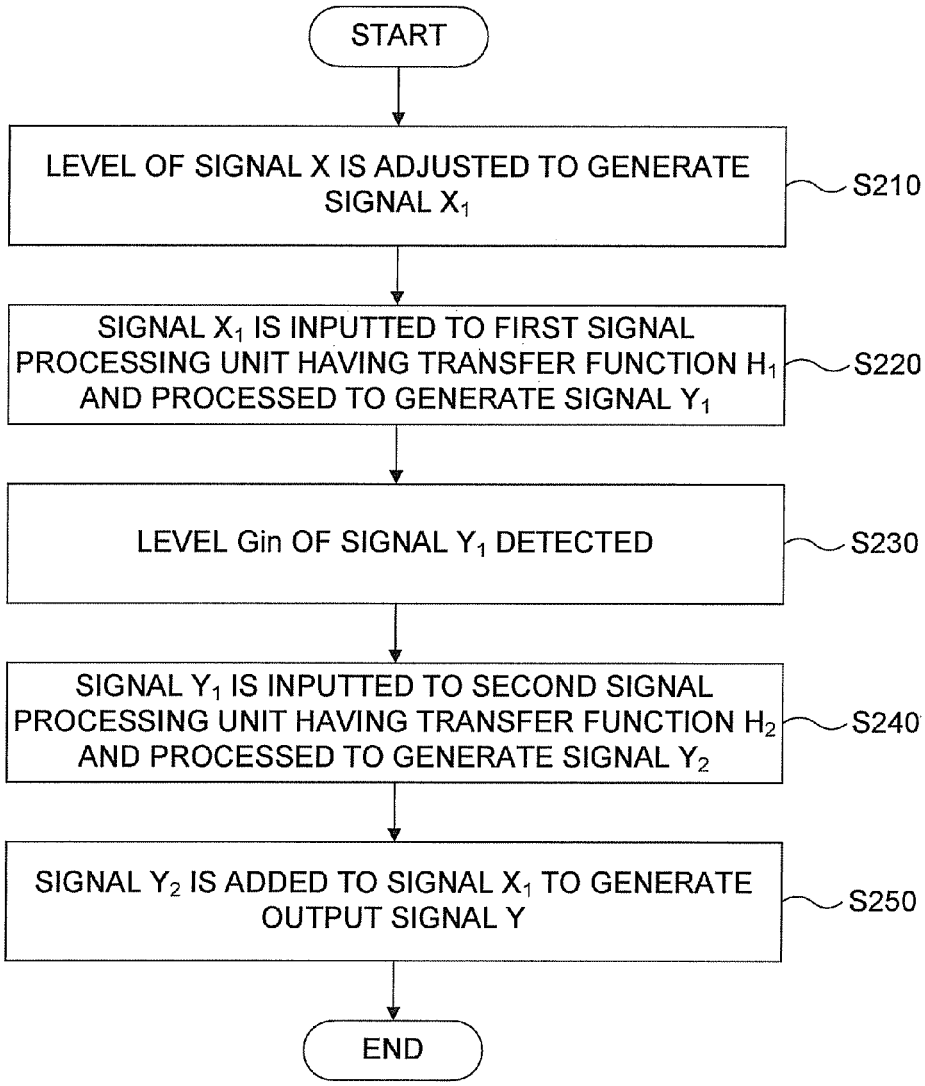
FIG. 8 is a flow diagram illustrating a method for adjusting a gain of a parametric equalizer system in accordance with the present invention.

FIG. 8 is a flow diagram illustrating a method for adjusting a gain of a parametric equalizer system in accordance with the present invention.

The method is performed in the parametric equalizer system including a parametric equalizer having a transfer function H(z) with a preset gain G as a parameter.

Referring to FIG. 8, an output signal $X_1$ is generated by adjusting a level of an input digital audio signal X (S210).

Thereafter, the output signal $X_1$ is inputted to a first signal processing unit having a transfer function $H_1$ and processed by the transfer function $H_1$ (S220). The transfer function $H_1$ is defined in Equation 2 above.

That is, the output signal $X_1$ is inputted to the first signal processing unit having the transfer function $H_1$, and the output signal $X_1$ is processed by the first signal processing unit to generate an output signal $Y_1$ ($=X_1H_1$).

Thereafter, a level Gin of the output signal $Y_1$ is detected (S230).

Thereafter, the output signal $Y_1$ of the first signal processing unit is inputted to a second signal processing unit having a transfer function $H_2$ and processed (S240). The transfer function $H_2$ is defined in Equation 3 above.

That is, the output signal $Y_1$ of the first signal processing unit is inputted to the second signal processing unit having the transfer function $H_2$ and the second signal processing unit processes the output signal $Y_1$ of the first signal processing unit according to the transfer function $H_2$ to generate an output signal $Y_2$ ($=X_1H_1H_2$).

Figure 9:
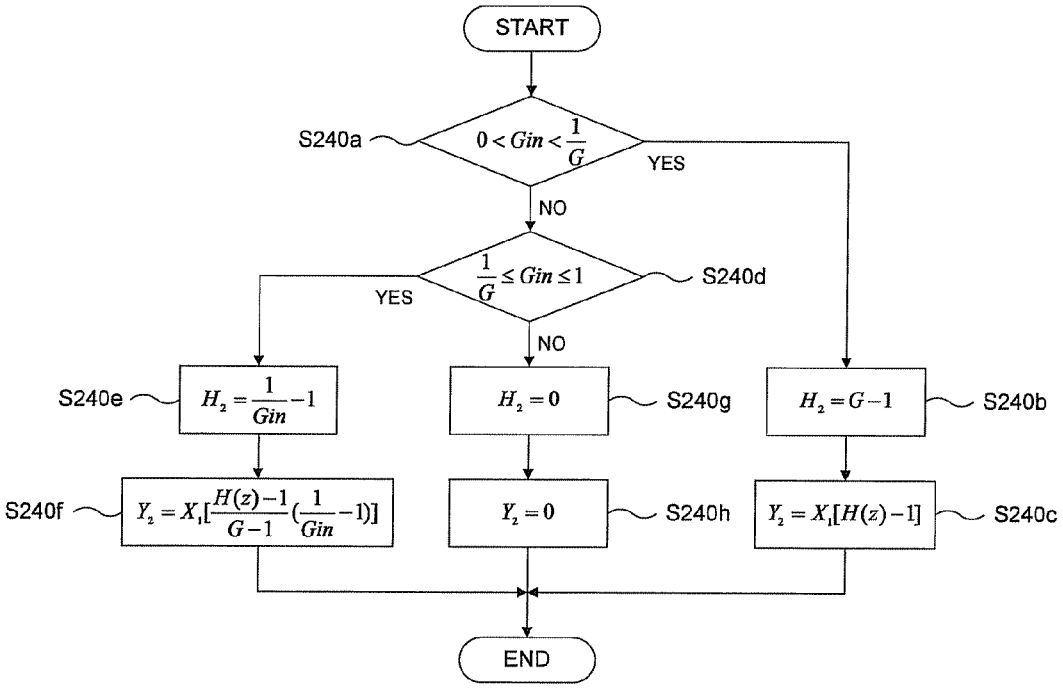
FIG. 9 is a flow diagram illustrating step S240 of FIG. 8.

The step S140 will be described in more detail below with reference to FIG. 9.

When $$0 < Gin < \frac{1}{G}$$

(240*a*), the transfer function $H_2$ is expressed as $H_2=G-1$ as in Equation 3 (S240*b*), and the second signal processing unit generates the output signal $Y_2$ ($=X_1[H(z)-1]$) (S240*c*).

When $$\frac{1}{G} \le Gin \le 1.$$

(S240*d*), the transfer function $H_2$ is expressed as $$H_2 = \frac{1}{Gin} - 1$$

as in Equation 3 (S240*e*), and the second signal processing unit generates the output signal $$Y_2\left( = X_1\left[\frac{H(z)-1}{G-1}\left(\frac{1}{Gin}-1\right)\right]\right)$$

(S240*f*).

When 1<Gin, the transfer function $H_2$ is expressed as $H_2=0$ as in Equation 3 (S240*g*), and the second signal processing unit generates the output signal $Y_2$ (=0) (S240*h*).

Referring back to FIG. 8, the output signal $Y_2$ is then added to the signal $X_1$ to generate an output digital audio signal Y (S250).

The output digital audio signal Y for $$0 < Gin < \frac{1}{G}$$

is expressed as Equation 10 above. The gain G of the parametric equalizer is not varied when $$0 < Gin < \frac{1}{G}$$

and the input digital audio signal is processed according to the preset gain G.

The output digital audio signal Y for $$\frac{1}{G} \le Gin \le 1$$

is expressed as Equation 12 above. When the level Gin is equal to or greater than 1/G and equal to or less than 1, the gain of the parametric equalizer monotonically decreases. That is, the gain of the parametric equalizer may be dynamically adjusted according to the level Gin without calculating the coefficients of H(z) in real time.

The output digital audio signal Y for 1<Gin is expressed as Equation 15. When 1<Gin, the output signal $X_1$ is equal to the output digital audio signal Y. That is, when the level Gin of the output signal $Y_1$ is greater than 1, the input digital audio signal $X_1$ is outputted as the output digital audio signal Y without amplification.

The parametric equalizer and the parametric equalizer system in accordance with the present invention differ from conventional ones in that:

(i) the parametric equalizer and the parametric equalizer in accordance with the present invention detects the level of the input signal and process the input signal according to the level while conventional the parametric equalizers process the input signal by the transfer function thereof regardless of the level of the input signal once the transfer function is defined by various parameters; and (ii) the parametric equalizer and the parametric equalizer in accordance with the present invention detects the level of the input signal and maintain or vary the gain thereof according to the level while conventional the parametric equalizers process the input signal by the transfer function thereof without varying the various parameters.

While the parametric equalizer and the parametric equalizer in accordance with the present invention are similar to the conventional ones in that the input signal is processed according to preset transfer functions, the parametric equalizer and the parametric equalizer in accordance with the present invention change the processing of the input signal according to the level of the input signal contrary to the conventional ones which process the input signal regardless of the level of the input signal.

The method, the parametric equalizer and the parametric equalizer system in accordance with the present invention has following advantages over conventional ones.

(i) The parametric equalizer and the parametric equalizer system capable of dynamically varying the gain thereof according to the level of the digital audio signal can be embodied without calculating the coefficients of the filter constituting the parametric equalizer in real time.

(ii) The parametric equalizer and the parametric equalizer system prevents the clopping and the distortion of the digital audio signal by varying the gain thereof according to the level of the digital audio signal.

(iii) The parametric equalizer and the parametric equalizer system can be embodied with a simpler hardware compared to the parametric equalizers which calculate the coefficients of the filter included therein in real time.

(iv) Low power and low cost parametric equalizer and the parametric equalizer system can be embodied compared to the parametric equalizers that calculate the coefficients of the filter included therein in real time.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A parametric equalizer having a transfer function H(z) with a preset gain G as a parameter, the parametric equalizer dynamically adjusting the preset gain G, the parametric equalizer comprising:

a first signal processing unit having a transfer function $H_1$, the first signal processing unit being configured to process an input digital audio signal X according to the transfer function $H_1$ and output a first output signal obtained by processing the input digital audio signal X;

a second signal processing unit having a transfer function $H_2$ of a level Gin of the first output signal, the second signal processing unit being configured to process the first output signal according to the transfer function $H_2$ and output a second output signal obtained by processing the first output signal; and an adder configured to add the second output signal to the input digital audio signal X to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

2. The parametric equalizer according to claim 1, wherein $Y=H(z)X$ when $0<Gin<1/G$.

3. The parametric equalizer according to claim 1, wherein a level of the output digital audio signal Y is maintained by monotonically decreasing the preset gain G when $1/G\leq Gin\leq 1$.

4. The parametric equalizer according to claim 1, wherein the output digital audio signal Y is equal to the input digital audio signal X when $1<Gin$.

5. A method of dynamically adjusting a preset gain G of a parametric equalizer having a transfer function H(z) with the preset gain G as a parameter, the method comprising:

(a) inputting an input digital audio signal X to a first signal processing unit having a transfer function $H_1$ and processing the input digital audio signal X according to the transfer function $H_1$ to generate an output signal $Y_1$;

(b) inputting the output signal $Y_1$ to a second signal processing unit having a transfer function $H_2$ of a level Gin of the output signal $Y_1$ and processing the output signal $Y_1$ according to the transfer function $H_2$ to generate an output signal $Y_2$; and (c) adding the output signal $Y_2$ to the input digital audio signal X to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

6. The method according to claim 5, wherein $Y=H(z)X$ when $0<Gin<1/G$.

7. The method according to claim 5, wherein a level of the output digital audio signal Y is maintained by monotonically decreasing the preset gain G when $1/G\leq Gin\leq 1$.

8. The method according to claim 5, wherein the output digital audio signal Y is equal to the input digital audio signal X when $1<Gin$.

9. A parametric equalizer system having a transfer function H(z) with a preset gain G as a parameter, the parametric equalizer dynamically adjusting the preset gain G, the parametric equalizer comprising:

a first signal processing unit configured to process a signal $X_1$ according to the transfer function $H_1$ to generate an output signal $Y_1$;

a level detector configured to detect a level Gin of the output signal $Y_1$;

a second signal processing unit configured to process the output signal $Y_1$ according to the transfer function $H_2$ of the level Gin detected by the level detector to generate an output signal $Y_2$; and an adder configured to add the output signal $Y_2$ to the signal $X_1$ to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

10. The parametric equalizer system according to claim 9, wherein $Y=H(z)X_1$ when $0<Gin<1/G$.

11. The parametric equalizer system according to claim 9, wherein a level of the output digital audio signal Y is maintained by monotonically decreasing the preset gain G when $1/G\leq Gin\leq 1$.

12. The parametric equalizer system according to claim 9, wherein the output digital audio signal Y is equal to the signal $X_1$ when $1<Gin$.

13. The parametric equalizer system according to claim 9, further comprising a volume controller configured to generate the signal $X_1$ by adjusting a level of an input digital audio signal X.

14. A method of dynamically adjusting a preset gain G of a parametric equalizer having a transfer function H(z) with the preset gain G as a parameter, the method comprising:

(a) inputting a signal $X_1$ to a first signal processing unit having a transfer function $H_1$ and processing the signal $X_1$ according to the transfer function $H_1$ to generate an output signal $Y_1$;

(b) detecting a level Gin of the output signal $Y_1$;

(c) inputting the output signal $Y_1$ to a second signal processing unit having a transfer function $H_2$ of the level Gin detected in the step (b) and processing the output signal $Y_1$ according to the transfer function $H_2$ to generate an output signal $Y_2$; and (d) adding the output signal $Y_2$ to the signal $X_1$ to generate an output digital audio signal Y (where $H_1=[H(z)-1]/(G-1)$, $H_2=G-1$ when $0<Gin<1/G$, $H_2=1/Gin-1$ when $1/G\leq Gin\leq 1$ and $H_2=0$ when $1<Gin$).

15. The method according to claim 14, wherein $Y=H(z)X_1$ when $0<Gin<1/G$.

16. The method according to claim 14, wherein a level of the output digital audio signal Y is maintained by monotonically decreasing the preset gain G when $1/G\leq Gin\leq 1$.

17. The method according to claim 14, wherein the output digital audio signal Y is equal to the signal $X_1$ when $1<Gin$.

18. The method according to claim 14, further comprising generating the signal $X_1$ by adjusting a level of an input digital audio signal X prior to performing the step (a).

* * * * *